United States Patent [19]

Alley

[11] Patent Number: 4,682,083

[45] Date of Patent: Jul. 21, 1987

[54] FLUORESCENT LAMP DIMMING ADAPTOR KIT

[75] Inventor: Robert P. Alley, Clifton Park, N.Y.

[73] Assignee: General Electric Company, Schenectady, N.Y.

[21] Appl. No.: 883,469

[22] Filed: Jul. 11, 1986

Related U.S. Application Data

[63] Continuation of Ser. No. 665,673, Oct. 29, 1984, abandoned.

[51] Int. Cl.[4] ..... H05B 37/02

[52] U.S. Cl. ..... 315/307; 315/291; 315/297; 315/287; 315/DIG. 4

[58] Field of Search ..... 315/307, 291, 297, 287, 315/DIG. 4, 194, 311, 308, 208

[56] References Cited

U.S. PATENT DOCUMENTS

| | | | |
|---|---|---|---|
| 3,265,907 | 8/1966 | Kurata et al. | 315/DIG. 4 |
| 4,395,660 | 7/1983 | Waszkiewicz | 315/DIG. 4 |
| 4,482,844 | 11/1984 | Schweer et al. | 315/297 |
| 4,523,129 | 6/1985 | Pitel | 315/DIG. 4 |
| 4,523,131 | 6/1985 | Zansky | 315/DIG. 4 |
| 4,529,913 | 7/1985 | Brosillon | 315/DIG. 4 |

*Primary Examiner*—Leo H. Boudreau
*Assistant Examiner*—Michael Razavi
*Attorney, Agent, or Firm*—Marvin Snyder; James C. Davis, Jr.

[57] ABSTRACT

A conventional non-dimming ballast for fluorescent lamps is modified to achieve a 100:1 dimming ratio by connecting a switching module to the ballast. The switching module switches current to and from the fluorescent lamps under control of a level control, resulting in the desired light output. The switching module may be connected either in series or in parallel with the lamps.

26 Claims, 13 Drawing Figures

FLUORESCENT LAMP DIMMING ADAPTOR KIT

This application is a continuation of application Ser. No. 665,673, filed Oct. 29, 1984, now abandoned.

The present invention relates in general to a fluorescent lamp dimming system and more specifically to modifying a conventional non-dimming ballast to a configuration which allows dimming of the fluorescent lamps.

BACKGROUND OF THE INVENTION

Specially designed ballasts for dimming fluorescent lamps are presently available and well known in the art. Many ballasts achieve dimming ratios of better than 1000:1. However, these systems operate as phase control systems, meaning that a large spike of current must flow along the power wiring to reignite the lamp when the lamp has not conducted for a period greater than about 1 millisecond. The resulting current and voltage spikes appear in the power line and may radiate from the lamps and building wiring causing electromagnetic interference (EMI) which may affect the operation of sensitive electronic equipment. It is especially important to keep transients off of the building wiring because it behaves like a transmission antenna and thus extends the range over which the EMI radiates.

Using specially designed dimming ballasts to replace one of the over 600 million U.S. installed 40 watt fluorescent lamps supplied by a non-dimming ballast in order to adapt an installation to a dimming system can be very expensive. Furthermore, these special dimming ballasts typically power only one lamp while most existing fluorescent lighting installations contain four or more lamps. Thus, it is desirable to be able to adapt the conventional non-dimming ballasts to a dimming configuration.

OBJECTS OF THE INVENTION

It is a principle object of the present invention to provide a new and improved fluorescent lamp dimming adaptor for modifying conventional non-dimming ballasts to a dimming configuration.

It is another object of the present invention to provide a new and improved fluorescent lamp dimming circuit which generates reduced electromagnetic interference.

It is yet another object of the present invention to provide a new and improved fluorescent lamp dimming circuit which achieves dimming while generating negligible net DC during a full waveform and hence no flicker..

It is a further object of the present invention to provide a fluorescent lamp dimming adaptor which achieves a dimming ratio on the order of 100:1 and which is field retrofitable with many different types of conventional ballasts.

SUMMARY OF THE INVENTION

These and other objects of the present invention are achieved by an add-on fluorescent lamp dimming adaptor which may be connected to a conventional non-dimming ballast for achieving dimming in a fluorescent lighting system. The adaptor comprises a switching module coupled to the lamp terminals for switching current from the lamp, and a level control coupled to the switching module for varying the duty cycle of the current in the lamp according to a dimming control signal supplied to the level control. The switching module may be connected to the ballast in parallel with the lamp, thereby shunting current from the lamps when the switching module closes, or may be connected in series with the lamp, thereby switching current from the lamp when the switching module opens.

According to the present invention, the level control may control the switching module by providing high frequency switching signals, the timing of these signals being referenced to the ac voltage supplied to the ballast. Alternatively, the level control may provide pulse width modulated (PWM) signals to the switching module from a PWM generator which is synchronized by a zero crossing detector to the ac voltage provided to the ballast. A sawtooth oscillator operating at a high frequency may also be used to provide PWM signals.

The features and advantages of the present invention will become apparent from the following detailed description of the invention when read with the accompanying drawings in which applicable reference numerals have been carried forward.

DETAILED DESCRIPTION OF THE INVENTION

Figure 1:
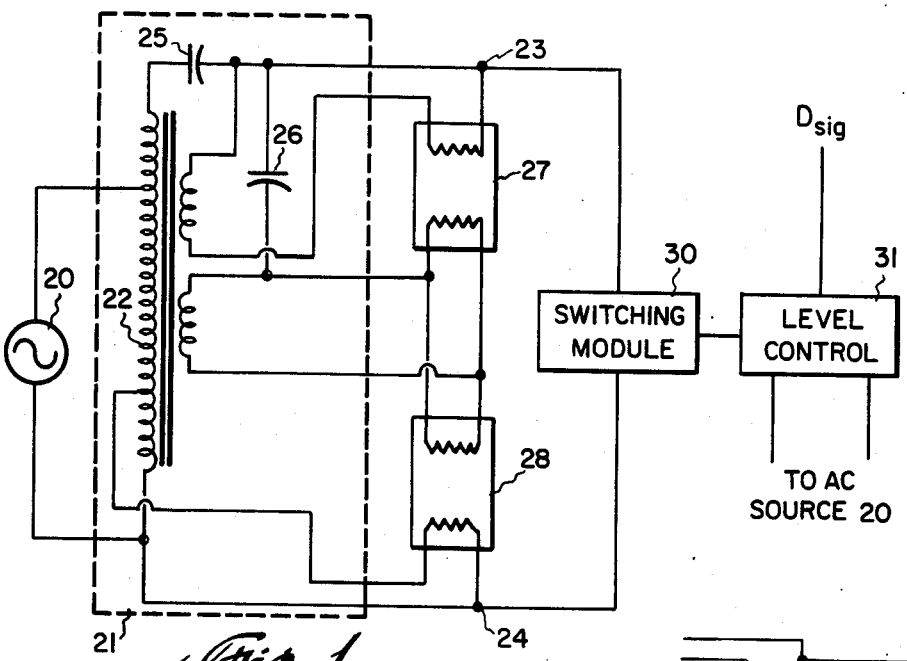
FIG. 1 is a part schematic diagram, part block diagram of a fluorescent lighting system including a conventional ballast and showing the add-on fluorescent lamp dimming adaptor of the present invention connected in parallel with the lamps.
Figure 1A:
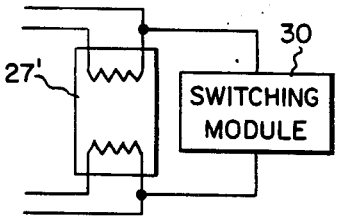
FIG. 1A shows the add-on fluorescent lamp dimming adaptor connected to a portion of a single lamp-fluorescent lighting system.
Figure 2:
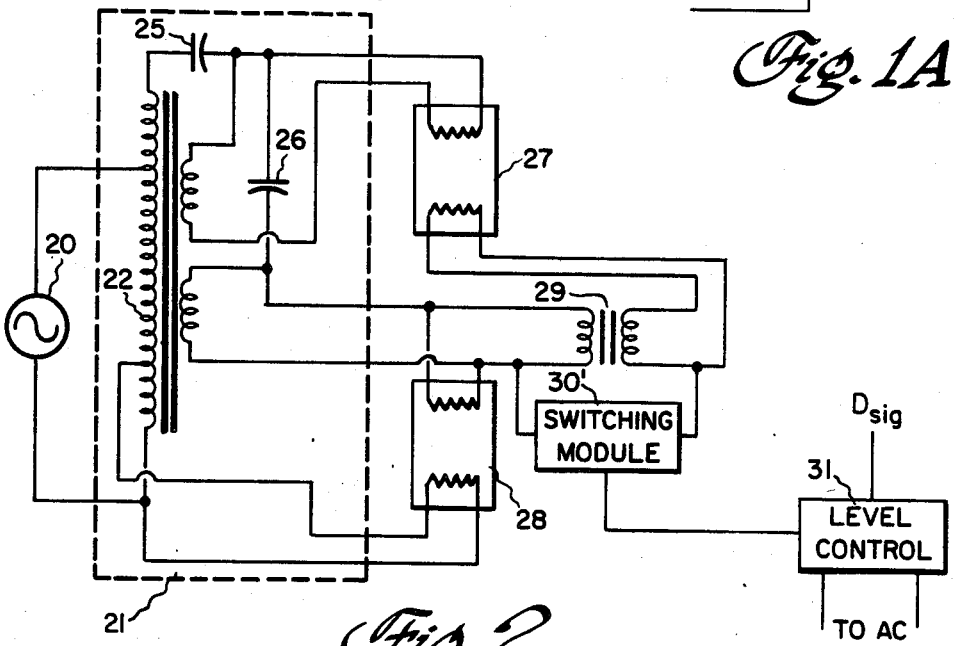
FIG. 2 is a part schematic diagram, part block diagram of a fluorescent lighting system including a conventional ballast and showing the add-on fluorescent lamp dimming adaptor of the present invention connected in series with the lamps.

Referring now to FIGS. 1 and 2, a dimmable fluorescent lighting system is seen to include an AC voltage source 20 (typically a 50 or 60 hertz power line) and a conventional rapid-start ballast 21 coupling the AC source to fluorescent lamps 27 and 28. By way of example, an 8G1022W ballast manufactured by the General Electric Co. is schematically illustrated. It comprises an autotransformer 22, a capacitor 25 and a start capacitor 26. The filaments of lamps 27 and 28 are heated by power supplied by windings closely coupled to the primary of autotransformer 22. Lamp voltage is provided by the secondary of autotransformer 22. While a rapid-start ballast (characterized by two series lamps and cathode heating) is shown in the drawings, the present invention is applicable to other conventional, non-dimming ballasts (both with and without filament heating) as will become apparent herein. For example, FIG. 1A shows a portion of a fluorescent lighting system having a single lamp 27' and being connected to the switching module portion 30 of the adaptor of the present invention.

The add-on fluorescent dimming adaptor of the present invention controllably varies the average lamp current to achieve brightness control. The adaptor is comprised of switching module 30 and a level control 31. Switching module 30 is a controllable switch for switching current from a lamp. It is possible to connect switching module 30 in series with the lamps, in which case lamp current is interrupted by opening switching module 30. With switching module 30 connected in parallel with the lamps, lamp current is diverted through the parallel path formed by closing switching module 30. Level control 31 causes switching module 30 to become conductive or non-conductive in a manner which dims the lamps. Specifically, a pulse of current from level control 31 causes switching module 30 to switch current from the lamps for a portion of the half cycle of the source voltage. The out-time of the lamp current is short enough to avoid deionization of the lamps, but may have a variable duration or a variable number of repetitions per half cycle to provide variable lamp brightness.

A first embodiment of the add-on fluorescent lamp dimming adaptor of the invention will now be described with reference to FIG. 1. In this embodiment, switching module 30 is connected in parallel with series-connected lamps 27 and 28 by electrically connecting the output of switching module 30 to lamp terminals 23 and 24 of ballast 21 which carry current to and from the lamps during an arc discharge. In this way, lamp current is controllably diverted from lamps 27 and 28 as switching module 30 becomes conductive, while normal lamp current flows in lamps 27 and 28 when switching module 30 is non-conductive. Level control 31, responsive to a dimming control signal $D_{sig}$, is coupled to switching module 30 for controlling the conduction state of switching module 30. Several schemes for providing appropriate switching signals from level control 31 to switching module 30 will be discussed later.

Figure 3:
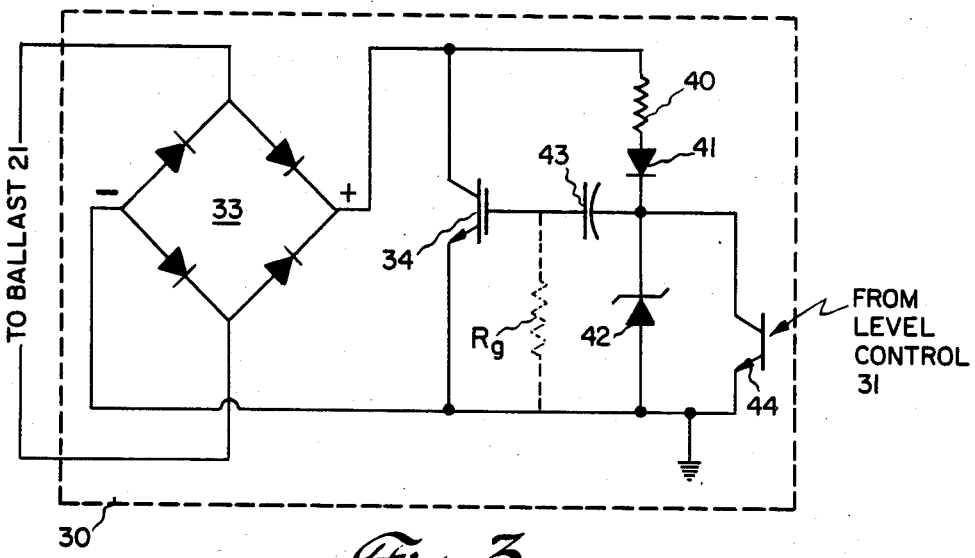
FIG. 3 is a circuit diagram of an exemplary switching module used in the adaptor of FIG. 1.

An embodiment of switching module 30 specially adapted to operate in parallel with fluorescent lamps 27 and 28 is shown in FIG. 3. A gate controlled semiconductor switch or insulated gate transistor (IGT) 34 connected across the output terminals of diode bridge rectifier 33 provides switching module 30 with a conducting state or a non-conducting state depending on the gate voltage of semiconductor switch 34. Switch 34 is shown to comprise an IGT, although other devices may be used, e.g. power field effect transistors (power FETs) and gate turn-off thyristors (GTOs). The IGT is preferred since its somewhat slower switching time results in lower EMI and lower voltage spike generation.

A gate circuit connected to semiconductor switch 34 comprises a resistor 40, a blocking diode 41 and a zener diode 42 connected in series between the collector and emitter of semiconductor switch 34. A capacitor 43 is connected between the gate of semiconductor switch 34 and the junction of diode 41 and zener diode 42. A phototransistor 44 has its collector connected to the junction of diode 41 and zener diode 42 and its emitter connected to the emitter of semiconductor switch 34. The zener diode holds a substantially constant voltage level across phototransistor 44 when the phototransistor is nonconductive. The base of phototransistor 44 is photocoupled to the output of level control 31, shown in FIG. 1. $R_g$ represents the leakage resistance of semiconductor switch 34 and may also comprise an additional resistor, if desired.

The embodiment of switching module 30 shown in FIG. 3 is designed such that IGT 34 is nonconductive in the long term absence of high frequency signals, in optical form, from level control 31 of FIGS. 1 and 2. Thus, a failure of level control 31 does not result in a permanent short-circuit across lamps 27 and 28. When relatively high frequency switching signals, in optical form, from level control 31 are present, IGT 34 is operated on an AC basis since capacitor 43 has a value higher than the effective gate capacitance. When a switching signal, in optical form, is provided by level control 31 in order to dim lamps 27 and 28 shown in FIG. 1, the junction between diode 41 and zener diode 42 is grounded by phototransistor 44, which turns on. The gate of IGT 34 is pulled down and IGT 34 does not conduct. When phototransistor 44 turns off, charge is supplied to the gate of IGT 34 by capacitor 43 turning IGT 34 on. If the signal from level control 31 remains high or low (due to some malfunction) or if phototransistor 44 shorts out between its collector and emitter, then any charge of the gate IGT 34 will eventually leak off through $R_g$. This drops the IGT gate-to-emitter voltage to zero, turning off IGT 34 and causing lamps 27 and 28 to operate at full brightness.

As shown by FIG. 2, switching module 30' may alternatively be connected in series with lamps 27 and 28. Where the fluorescent lighting system being modified includes filament heating, a transformer 29 is used so that full filament power is continuously supplied regardless of the conduction state of switching module 30'. Although transformer 29 is shown connected between lamps 27 and 28, it will be understood that transformer 29 may be connected to any filament.

In the series-connected embodiment of the fluorescent dimming adaptor shown in FIG. 2, switching module 30' bridges transformer 29 so that lamp current may be controllably interrupted without affecting filament power. For a fluorescent lighting system having lamps without filaments, transformer 29 is not needed and switching module 30' is connected in series with the lamps by insertion into the ballast circuit in a convenient location. The input to switching module 30' is coupled to level control 31 and is controlled according to the switching schemes which are discussed below.

Figure 4:
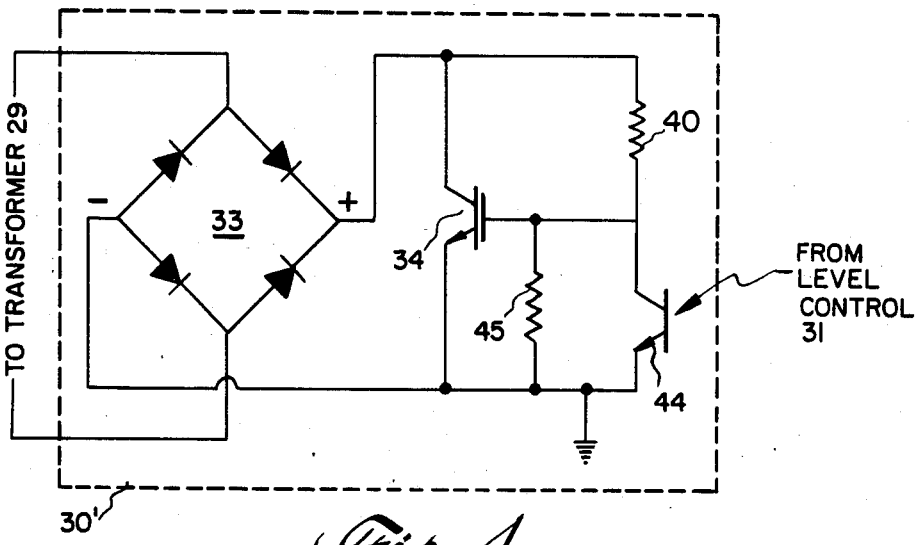
FIG. 4 is a circuit diagram of an exemplary switching module used in the adaptor of FIG. 2.

FIG. 4 shows switching module 30' having a gate circuit which specially adapts switching module 30' shown in FIG. 2, to series operation, wherein diode 41 and capacitor 43 have been replaced by direct connections, zener diode 42 has been removed from the circuit, and resistor 45 has been added. When there is no optical signal from level control 31, lamp current will turn on IGT 34 because resistors 40 and 45 form a voltage divider providing sufficient gate voltage to turn on IGT 34. When an optical signal is received from level control 31, phototransistor 44 will ground the gate of IGT 34 to the emitter of IGT 34. This turns off IGT 34 and lamp current as well.

Figure 5A:
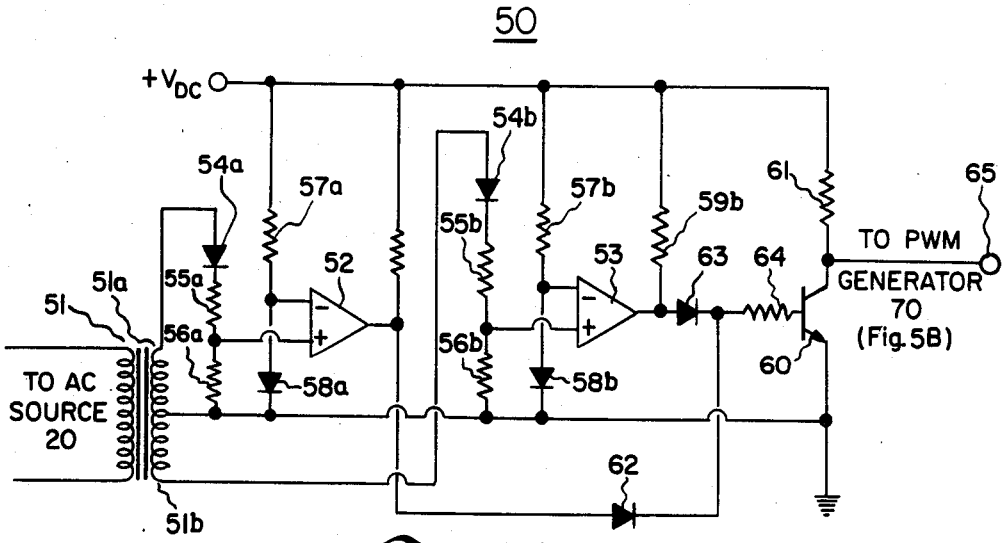
FIGS. 5A and 5B are circuit diagrams of a zero crossing detector and a PWM generator, respectively, used in one embodiment of the level control of the present invention.
Figure 5B:
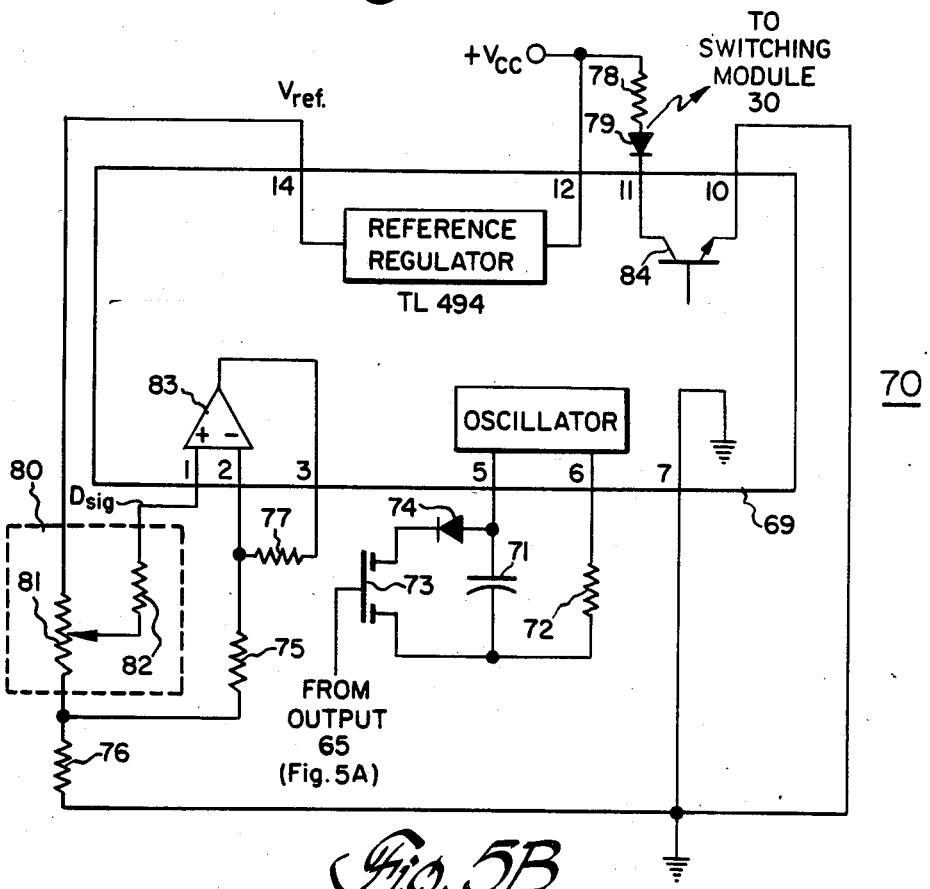
Figure 6:
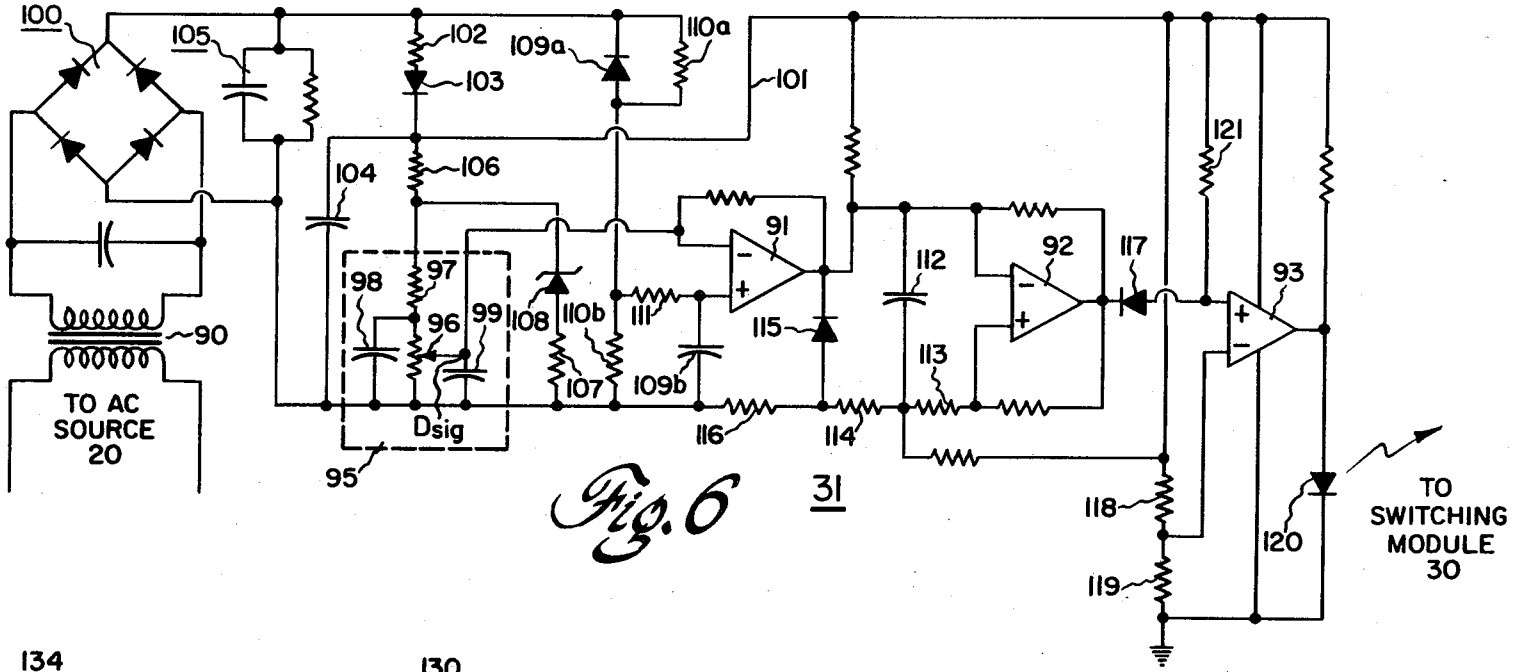
FIG. 6 is a circuit diagram of a high frequency chopping circuit used in another embodiment of the level control of the present invention.
Figure 7:
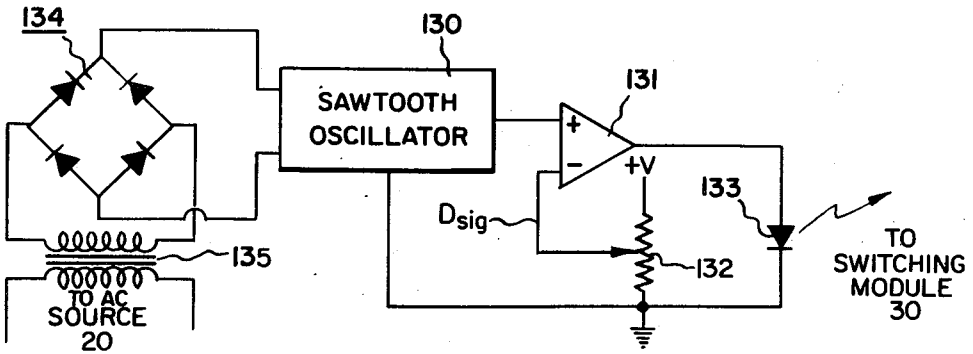
FIG. 7 illustrates a further embodiment of the level control employed in the present invention which also generates pulse width modulated switching signals.

FIGS. 5–7 show level control circuitry for effecting several different switching schemes for switching module 30 of FIGS. 1–4, any embodiment of which may be used in either the series or the parallel connection of switching module 30 or 30′ in the circuits of FIG. 1 or 2, respectively. Level control 31 must switch fast enough so that lamps 27 and 28 do not have time to de-ionize between conduction periods, thus avoiding re-ignition problems, e.g. high voltage spikes. Furthermore, by switching at a frequency substantially higher than the AC line frequency, one may avoid the resonant frequency of the ballast. A high switching frequency is also desirable because the conventional rapid-start ballast acts like a low-pass filter, preventing EMI-producing voltage transients from reaching the AC line. Transients are further controlled by the grounding of the metal fixture of the lighting installation. Preferably, level control 31 causes switching module 30 to switch at a rate of 300 to 3000 cycles per second and higher. In addition, level control 31 should be synchronized to the AC line so that there is negligible net DC in lamps 27 and 28 during each full waveform of the AC line voltage to avoid the appearance of flicker resulting from different light production on one half cycle of line voltage then on the next half cycle.

Figure 8A:
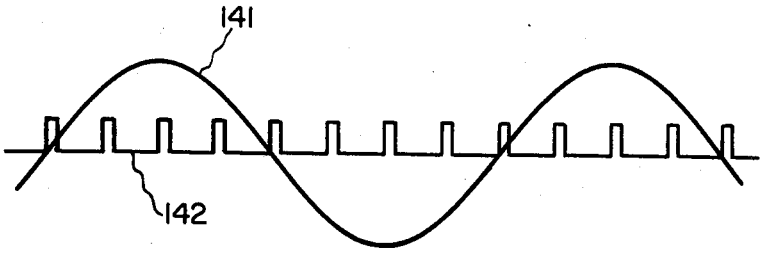
FIGS. 8*a*, 8*b*, 9*a* and 9*b* are waveform diagrams showing the pulses produced by the level control of the present invention in relation to the supplied voltage.
Figure 8B:
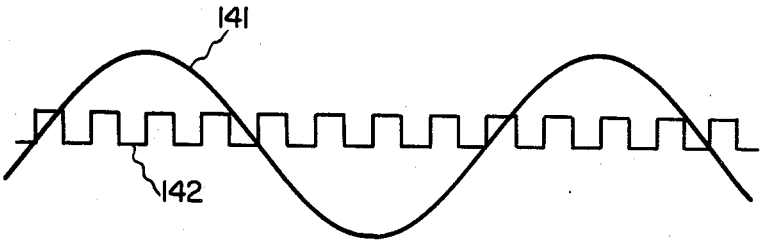

A first embodiment of level control 31 comprises a zero crossing detector 50 shown in FIG. 5A driving a PWM generator 70 shown in FIG. 5B. Level control 31 generates pulse width modulated signals for controlling switching module 30 or 30′ to switch current from lamps 27 and 28. FIGS. 8A and 8B illustrate the output signals of level control 31, shown in FIGS. 5A and 5B, for a lesser and a greater amount of dimming, respectively. In both instances, a PWM output signal 142 in the form of optical pulses is shown to be synchronized with AC voltage 141 from AC source 20.

Zero crossing detector 50 is coupled to AC source 20 by a voltage sensing transformer 51 with a center-tapped secondary. The center-tap is connected to ground. Each end of the transformer secondary is connected to a separate input, respectively, of a separate comparator circuit, respectively, for detecting when each rectified half-wave of the source voltage exceeds one diode drop (across diodes 58*a* and 58*b*, respectively). A comparator 52 has its non-inverting input coupled to one end 51*a* of the secondary of transformer 51 through a series-connected diode 54*a* and resistor 55*a* and coupled to the center-tap of the secondary through a resistor 56*a*. The inverting input of comparator 52 is coupled to a source of constant DC voltage $+V_{DC}$ through a resistor 57*a* and coupled to the center-tap of the secondary through a diode 58*a*. DC voltage $+V_{DC}$ may be supplied in any convenient way, e.g. the regulated output of a rectifier connected to ac source 20. A pullup resistor 59*a* is coupled between the output of comparator 52 and DC voltage $+V_{DC}$. The output of comparator 52 is also coupled to the base of a transistor 60 through a series-connected diode 62 and resistor 64. The noninverting and inverting inputs of a comparator 53 are coupled to the other end 51*b* of the secondary of transformer 51 and to DC voltage $+V_{DC}$, respectively, by circuitry identical to that described for comparator 52. The output of comparator 53 is connected to pullup resistor 59*b* and is coupled to the base of transistor 60 through a series-connected diode 63 and resistor 64. Thus, diodes 62 and 63 constitute input circuitry, and resistor 64 the output circuitry, of an OR gate. The collector of transistor 60 is coupled to $+V_{DC}$ through a resistor 61 and is coupled to PWM generator 70 through an output 65. The emitter of transistor 60 is connected to ground and to the transformer center-tap.

When an AC voltage is supplied to voltage sensing transformer 51, comparators 52 and 53 will each sense voltages at their noninverting inputs greater than the voltage drops across diodes 58*a* and 58*b*, respectively, during each half cycle of opposite polarity, respectively. A high output from either comparator 52 or 53 turns on transistor 60, shorting output 65 to ground. When there is no signal from either comparator 52 or 53, i.e. in the vicinity of the zero crossings of AC source 20, output 65 goes high. The resulting pulses on output 65 are provided to PWM generator 70.

PWM generator 70 may comprise a commercially available integrated circuit. A pulse width modulation control circuit TL494C manufactured by Texas Instruments Incorporated is shown in FIG. 5B as pulse width modulation control circuit chip 69. All the circuit elements external to TL494C chip 69 and some of the internal circuitry of chip 69 are shown in FIG. 5B. Pin 12 of chip 69 is provided with a positive DC voltage $+V_{cc}$. Pin 7 is grounded.

The pulse repetition rate of PWM generator 70 is determined by the values of a capacitor 71 and a resistor 72 connected to the oscillator between pins 5 and 6 of chip 69. As previously discussed, these values should be selected to provide from 300 to 3000 pulses per second and higher from the oscillator. The oscillator in chip 69 is synchronized to AC source 20 by stopping the oscillator and restarting it with each pulse received from output 65 of zero crossing detector 50. This is done by shunting capacitor 71 with a series-connected diode 74 and FET 73. The gate of FET 73 is coupled to output 65 of the zero crossing detector shown in FIG. 5A. By synchronizing PWM generator 70 to AC source 20 in this way, only negligible net DC may be generated across lamps 27 and 28, shown in FIGS. 1 and 2, during any full cycle of AC source 20.

The duty cycle of PWM generator 70 is determined by an error amplifier 83 in chip 69. A reference voltage $V_{ref}$ is supplied by pin 14 to a dimming control 80. Potentiometer 81 and resistor 82 connected to the potentiometer tap supply a dimming control signal $D_{sig}$ to pin 1 of chip 69, connected to the non-inverting input of error amplifier 83. A second voltage, less than $V_{ref}$, is provided to pin 2, connected to the inverting input of the error amplifier, through a resistance 75 from a voltage divider comprised of potentiometer 81 and a resistor 76. A feedback resistor 77 is connected between pin 2 and pin 3 for providing a constant gain for error amplifier 83. The duty cycle of PWM generator 70 is thus controlled by varying the output of potentiometer 81.

The PWM output of chip 69 internally operates an output transistor 84 with its collector connected to pin 11 and its emitter connected to pin 10. A resistor 78 and a light-emitting diode (LED) 79 are connected in series between $+V_{cc}$ and pin 11. Pin 10 is grounded. Thus, the PWM output modulates LED 79 which is optocoupled to switching module 30.

Figure 9A:
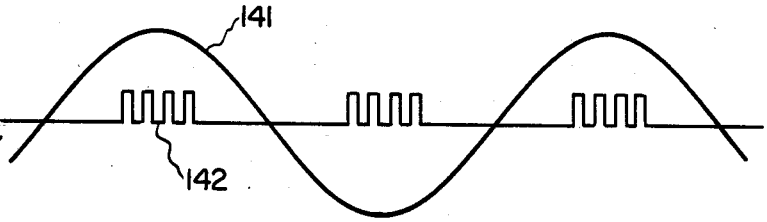
Figure 9B:
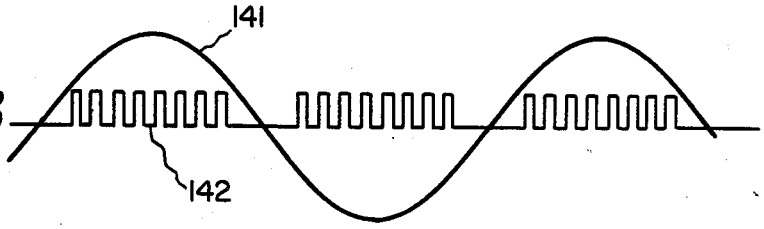

A second embodiment of level control 31 produces pulses 142 of fixed width and frequency, as shown in FIGS. 9A and 9B, but for a controllably variable time (or chopping interval) centered in each half wave 141 of th AC power source. The pulses of FIG. 9B provide more dimming than the pulses of FIG. 9A since they are generated during longer intervals and thus result in a lower duty cycle of the current in the lamp.

A circuit for level control 31 is shown in FIG. 6. Level control 31 is supplied from AC source 20 through an isolation transformer 90. Full-wave rectified voltage is provided at the output of diode bridge rectifier 100. A DC bus 101 is coupled to rectifier 100 through resistor 102 and diode 103 in series. The DC bus voltage is smoothed by a filter capacitor 104. A parallel RC transient suppression circuit 105 limits voltage spikes appearing in level control 31.

A dimming control 95 receives a DC reference voltage through a resistor 106. Series-connected resistor 107 and zener diode 108 are connected across, and thereby tend to regulate voltage on, dimming control 95, thus providing dimming control 95 with partial compensation for line fluctuations. Dimming control 95 comprises a resistor 97 and a potentiometer 96 connected in series and energized from resistor 106. The tap of potentiometer 96 provides a variable DC output signal $D_{sig}$. Potentiometer 96 may be replaced by a fixed voltage divider and a switch providing discrete levels of dimming. Small decoupling capacitors 98 and 99 increase noise immunity.

The tap of potentiometer 96 is coupled to the inverting input of a comparator 91. Full-wave rectified signals from a voltage divider comprised of series-connected resistors 110*a* and 110*b* connected across rectifier 100 are provided to the non-inverting input of comparator 91 through resistor 111. A diode 109*a* provides a discharge path for noise filter 109*b*. Square wave signals are provided at the output of comparator 91 which are high when the full-wave rectified voltage produced by rectifier 100 and sensed through resistors 100 and 111 is greater than $D_{sig}$. Thus, the width of the high portions of square waves provided by comparator 91 may be varied under control of dimming control 95.

The output signal of comparator 91 is supplied to the inverting input of an operational amplifier 92. Operational amplifier 92 is connected, in conventional fashion, to act as an oscillator when the output of comparator 91 is high. Thus, a timing capacitor 112, resistors 113 and 114 and a diode 115 control the switching frequency of operational amplifier 92, which is selected to produce pulses at a frequency of 300 to 3000 pulses per second or higher. Thus, high frequency pulses are provided at the output of operational amplifier 92 during periods that $D_{sig}$ is lower than the full-wave rectified voltage provided to the non-inverting input of comparator 91, i.e. symmetrically around the center of each half-wave. If $D_{sig}$ is greater than this full-wave rectified voltage then no high frequency pulses are provided by operational amplifier 92.

The non-inverting input of an operational amplifier 93 is coupled to the output of operational amplifier 92 through diode 117 and to bus 101 through a resistor 121. The inverting input of operational amplifier 93 is connected to a DC voltage equal to the DC voltage on bus 101 reduced by a voltage divider comprising resistors 118 and 119. When the output of operational amplifier 92 goes low, diode 117 is forward biased and provides a low input voltage to the noninverting input of operational amplifier 93. A high output from operational amplifier 92 causes a high input voltage to operational amplifier 93. Thus, operational amplifier 93 isolates operational amplifier 92 and provides increased current, high frequency pulses during the center portion of each half-wave of voltage provided by rectifier 100 (but only when the voltage from rectifier 100 is greater than $D_{sig}$) and provides a low output signal otherwise.

An LED 120 is connected between the output of operational amplifier 93 and ground. High frequency switching signals are provided to switching module 30 (FIGS. 3 and 4) through the optocoupling of LED 120 and phototransistor 44.

A further embodiment of level control 31 will now be described with reference to FIG. 7. FIG. 7 shows a simplified method for providing PWM signals which, however, are not synchronized to AC source 20. A diode rectifier 134 is coupled to AC source 20 through an isolation transformer 135. Rectifier 134 supplies a sawtooth oscillator 130 which operates at a frequency greater than about 2000 hertz. The output of sawtooth oscillator 130 is supplied to the non-inverting input of a comparator 131. A potentiometer 132 is connected between a constant DC voltage +V and ground. The output of potentiometer 132 provides $D_{sig}$ to the inverting input of comparator 131. The output of comparator 131 provides PWM signals to an LED 133 which are optocoupled to switching module 30 of FIGS. 3 and 4. It is possible to operate the circuit shown in FIG. 7 without synchronization with AC source 20 because of the high frequency of sawtooth oscillator 130 which avoids the generation of any significant net DC voltage across the lamps over any full cycle of AC source 20.

With any of the above described embodiments of level control 31 it is possible to control the dimming of more than just the lamps connected to one ballast. A plurality of switching modules can be connected to a like plurality of conventional ballasts and can be optocoupled to a single level control by providing a plurality of LEDs (either in series or in parallel) in the level control.

From the foregoing, it is apparent that the invention achieves the objects of a wide range of dimming and low electromagnetic interference generation in a dimming adaptor for modifying conventional non-dimming ballasts. The inductance of the ballast prevents large current surges from being transferred to the AC line. Further, in the rapid-start ballast, the starting capacitor provides over-voltage control. In the parallel arrangement of the switching module, voltage transients are limited to about 200 volts because the lamps will undergo an arc discharge and ignite. Thus, the low EMI generated by the dimming adaptor of the present invention will allow lamp dimming without affecting the operation of nearby electronic equipment.

While preferred embodiments of the present invention have been shown and described herein, it will be obvious that such embodiments are provided by way of example only. Numerous variations, changes, departures, substitutions and partial and full equivalents will now occur to those skilled in the art without departing from the invention herein. Accordingly, it is intended that the invention be limited by the spirit and scope of the appended claims.

What is claimed is:

1. An add-on fluorescent lamp dimming adaptor for connecting to a conventional nondimming ballast in a fluorescent lighting system, said system including a source of ac voltage, said ballast having terminals for connecting to a fluorescent lamp, said adaptor comprising:

a switching module adapted to be coupled to said terminals for switching current from said lamp, said switching module being connected in parallel with said lamp so as to divert current from said lamp when said switching module conducts; and a level control coupled to said switching module, said level control controlling the conductive state of said switching module to vary the current in said lamp according to a dimming control signal supplied to said level control, said level control causing said switching module to switch at a frequency in the range of 300 hertz and higher during times that said lamp current is being varied.

2. The fluorescent lamp dimming adaptor recited in claim 1 wherein said switching module comprises a gate controlled semiconductor switch and a diode bridge rectifier, said semiconductor switch being coupled to the output of said diode rectifier.

3. The fluorescent lamp dimming adaptor of claim 1 wherein said level control is adapted to be coupled to said ac source voltage and is synchronized to the zero crossings of said ac source voltage.

4. The fluorescent lamp dimming adaptor recited in claim 1 wherein said level control comprises:

a zero crossing detector connected to said ac source;

a PWM generator for generating a pulse train which is pulse width modulated according to said dimming control signal, said PWM generator being reset by said zero crossing detector at each zero crossing of said ac source voltage; and a light emitting diode connected to the output of said PWM generator for optocoupling to said switching module.

5. The fluorescent lamp dimming adaptor recited in claim 4 wherein said switching module comprises a gate controlled semiconductor switch, a diode bridge rectifier and a gate circuit, said semiconductor switch being coupled to the output of said diode rectifier, said gate circuit being photo-coupled to said light emitting diode.

6. The fluorescent lamp dimming adaptor recited in claim 5 wherein said gate controlled semiconductor switch comprises an IGT.

7. The fluorescent lamp dimming adaptor recited in claim 1 wherein said level control comprises:

circuit means for providing high frequency switching signals for a variable portion of each half wave of the voltage in the primary circuit of said ballast according to said dimming control signal; and a light emitting diode connected to the output of said circuit means for optocoupling to said switching module.

8. The fluorescent lamp dimming adaptor recited in claim 7 wherein said switching module comprises a gate controlled semiconductor switch, a diode bridge rectifier and a gate circuit, said semiconductor switch being coupled to the output of said diode rectifier, and said gate circuit being photo-coupled to said light emitting diode.

9. The fluorescent lamp dimming adaptor recited in claim 8 wherein said gate controlled semiconductor switch comprises an IGT.

10. The fluorescent lamp dimming adaptor recited in claim 1 wherein said level control comprises:

a sawtooth oscillator coupled to said ac source; and a comparator having one input coupled to the output of said oscillator and a second input responsive to said dimming control signal, the output of said comparator being coupled to said switching module.

11. The fluorescent lamp dimming adaptor recited in claim 10 wherein said sawtooth oscillator operates at a frequency in the range of 3000 hertz and higher.

12. An add-on fluorescent lamp dimming adaptor for connecting to a conventional rapid-start ballast in a fluorescent lighting system, said fluorescent lighting system including a source of ac voltage, said ballast having terminals for connecting to two series-coupled fluorescent lamps, said adapter comprising:

a switching module adapted to be coupled to said terminals for switching current from said lamps, said switching module being connected in parallel with said lamps; and a level control coupled to said switching module, said level control controlling the conductive state of said switching module to vary the current in said lamps according to a dimming control signal supplied to said level control, said level control causing said switching module to switch at a frequency in the range of 300 hertz and higher during times when the current in said lamps is being varied.

13. The fluorescent lamp dimming adaptor recited in claim 12 wherein said switching module comprises a gate controlled semiconductor switch and a diode bridge rectifier, said semiconductor switch being coupled to the output of said diode rectifier.

14. An add-on fluorescent lamp dimming adaptor for connecting to a conventional nondimming ballast in a fluorescent lighting system, said system including a source of ac voltage, said ballast having terminals for connecting to a fluorescent lamp, said adaptor comprising:

a switching module adapted to be coupled in series with said terminals and said lamp for switching current through said lamp, said switching module thus conducting current to said lamp when said module is conductive and interrupting current to said lamp when said module is nonconductive; and a level control coupled to said switching module, said level control controlling the conductive state of said switching module to vary the current in said lamp according to a dimming control signal supplied to said level control, said level control causing said switching module to switch at a frequency in the range of 300 hertz and higher during times when said lamp current is being varied.

15. The fluorescent lamp dimming adaptor of claim 14 wherein said switching module comprises a gate controlled semiconductor switch and a diode bridge rectifier, said semiconductor switch being coupled to the output of said diode rectifier.

16. The fluorescent lamp dimming adaptor of claim 14 wherein said level control is adapted to be coupled to said ac source voltage and is synchronized to the zero crossings of said ac source voltage.

17. The fluorescent lamp dimming adaptor of claim 14 wherein said level control comprises:

a zero crossing detector connected to said ac source;

a PWM generator for generating a pulse train which is pulse width modulated according to said dimming control signal, said PWM generator being reset by said zero crossing detector at each zero crossing of said ac source voltage; and a light emitting diode connected to the output of said PWM generator for optocoupling to said switching module.

18. The fluorescent lamp dimming adaptor of claim 17 wherein said switching module comprises a gate controlled semiconductor switch, a diode bridge rectifier and a gate circuit, said semiconductor switch being coupled to the output of said diode rectifier, said gate circuit being photo-coupled to said light emitting diode.

19. The fluorescent lamp dimming adaptor of claim 18 wherein said gate controlled semiconductor switch comprises an IGT.

20. The fluorescent lamp dimming adaptor of claim 14 wherein said level control comprises:

circuit means for providing high frequency switching signals for a variable portion of each half wave of the voltage in the primary circuit of said ballast according to said dimming control signal; and a light emitting diode connected to the output of said circuit means for optocoupling to said switching module.

21. The fluorescent lamp dimming adaptor of claim 20 wherein said switching module comprises a gate controlled semiconductor switch, a diode bridge rectifier and a gate circuit, said semiconductor switch being coupled to the output of said diode rectifier, and said gate circuit being photo-coupled to said light emitting diode.

22. The fluorescent lamp dimming adaptor of claim 21 wherein said gate controlled semiconductor switch comprises an IGT.

23. The fluorescent lamp dimming adaptor of claim 14 wherein said level control comprises:

a sawtooth oscillator coupled to said ac source; and a comparator having one input coupled to the output of said oscillator and a second input responsive to said dimming control signal, the output of said comparator being coupled to said switching module.

24. The fluorescent lamp dimming adaptor of claim 23 wherein said sawtooth oscillator operates at a frequency in the range of 3,000 hertz and higher.

25. An add-on fluorescent lamp dimming adaptor for connecting to a conventional rapid-start ballast in a fluorescent lighting system, said fluorescent lighting system including a source of ac voltage, said ballast having terminals for connecting to two fluorescent lamps, and a transformer coupled between said lamps, said adaptor comprising:

a switching module adpated to be coupled to said terminals for switching current from said lamps, said switching module being coupled in series with said lamps and briding said transformer; and a level control coupled to said switching module, said level control controlling the conductive state of said switching module to vary the current in said lamps according to a dimming control signal supplied to said level control, said level control causing said switching module to switch at a frequency in the range of 300 hertz and higher during times when the current in said lamps is being varied.

26. The fluorescent lamp dimming adaptor recited in claim 25 wherein said switching module comprises a gate controlled semiconductor switch and a diode bridge rectifier, said semiconductor switch being coupled to the output of said diode rectifier.

* * * * *